US006229675B1

(12) United States Patent
Tanaka et al.

(10) Patent No.: US 6,229,675 B1
(45) Date of Patent: May 8, 2001

(54) SWING ARM ACTUATOR FOR MAGNETIC DISK UNIT

(75) Inventors: Kenji Tanaka, Sagamihara; Hitoshi Hasegawa, Fujimi, both of (JP)

(73) Assignees: Nippon Petrochemicals Co., Ltd, Tokyo; Nittoku Giken Company, Ltd., Saitama, both of (JP)

( * ) Notice: Subject to any disclaimer, the term of this patent is extended or adjusted under 35 U.S.C. 154(b) by 0 days.

(21) Appl. No.: 09/420,536

(22) Filed: Oct. 19, 1999

Related U.S. Application Data

(63) Continuation of application No. 08/775,897, filed on Jan. 2, 1997, now abandoned, which is a continuation-in-part of application No. 08/256,889, filed on Sep. 28, 1994, now abandoned.

(30) Foreign Application Priority Data

Jan. 20, 1993 (JP) ..... 5-32581
Oct. 11, 1993 (JP) ..... 5-303305
Nov. 10, 1993 (JP) ..... 5-303306

(51) Int. Cl.[7] ..... H01F 7/08
(52) U.S. Cl. ..... 360/265
(58) Field of Search ..... 360/265, 266.9

(56) References Cited

U.S. PATENT DOCUMENTS 4,879,617 * 11/1989 Sampietro et al. ..... 360/106
5,091,710 * 2/1992 Ohba et al. ..... 335/229
5,122,703 * 6/1992 Takahashi et al. ..... 310/36
5,168,185 * 12/1992 Umehara et al. ..... 310/15
5,179,482 * 1/1993 Tanaka et al. ..... 360/97.01
5,305,169 * 4/1994 Anderson et al. ..... 360/105
5,623,759 * 4/1997 Thorson et al. ..... 29/603.04
5,650,896 * 7/1997 Viskochil ..... 360/106

FOREIGN PATENT DOCUMENTS 2-79763 * 3/1990 (JP) .
5-328651 * 12/1993 (JP) .

* cited by examiner

*Primary Examiner*—David Davis
(74) *Attorney, Agent, or Firm*—Bucknam and Archer

(57) ABSTRACT

A swing-type actuator for use in a magnetic disk unit which includes a magnetic head; an arm supporting the head and a movable coil acting in a magnetic circuit. The movable coil is composed of a coil bobbin having a conductive wire wrapped around the bobbin. The bobbin is produced by injection molding into the bobbin of a thermoplastic resin having a flexural modulus of at least $8\times10^2$ kgf/mm$^2$ and a heat deformation temperature of at least 200° C. under a load of 18.6 kg/cm$^2$. A junction member to which the arm and the bobbin are integrally fixed by insert molding is made of the same resin as the bobbin or another thermoplastic resin being selected from the group consisting of a polybutylene terephthalate resin, a polyphenylene sulfide resin, a polyamide, a polyether ether ketone resin and thermotropic liquid crystal polymer.

1 Claim, 7 Drawing Sheets

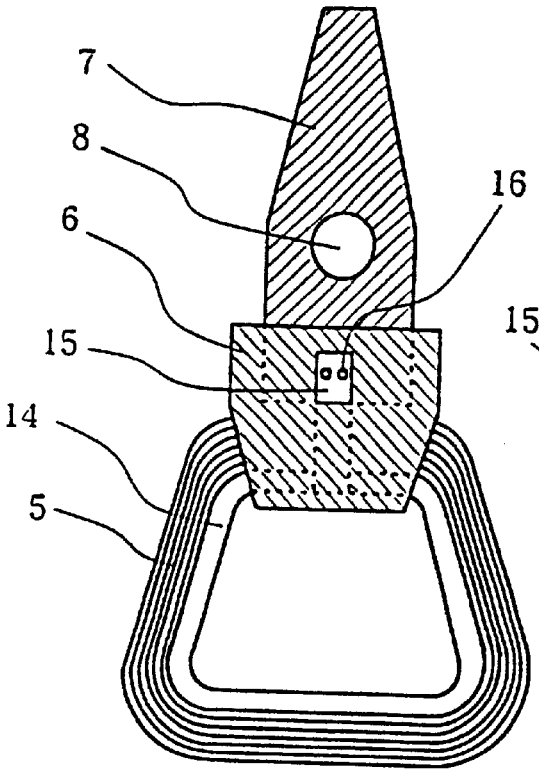
Fig. 5 (a)
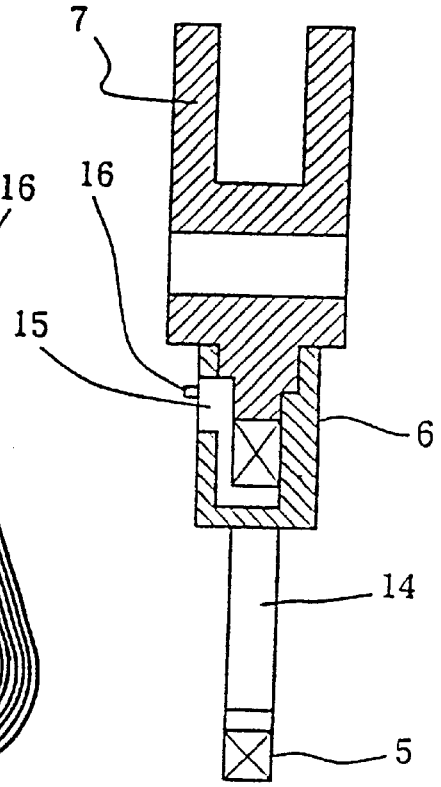
Fig. 5 (b)
Fig. 6 (a)
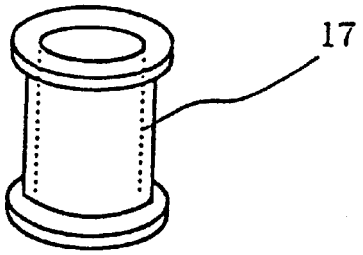
Fig. 6 (b)
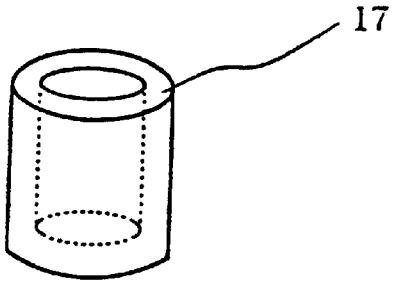

SWING ARM ACTUATOR FOR MAGNETIC DISK UNIT

This application is a continuation of application Ser. No. 08/775,897, filed Jan. 2, 1997 abandoned, which is a continuation-in-part of application Ser. No. 08/256,889, filed Sep. 28, 1994 now abandoned.

TECHNICAL FIELD

The present invention relates particularly to a swing-type actuator for use in a magnetic disk unit, for example, a fixed magnetic disk unit, having a magnetic head mounted thereon, wherein a functional member, such as the magnetic head, swings so as to draw a circular arc locus.

BACKGROUND ART

The conventional swing-type actuator has such a structure as illustrated in the plan of FIG. 1(*a*) and the front view of FIG. 1(*b*). In FIG. 1, numeral 1 denotes a yoke, numeral 2 a permanent magnet, numeral 3 a strut, numeral 4 a magnetic gap, numeral 5 a moving coil, numeral 6 a junction member, numeral 7 an arm, and numeral 8 a shaft. In the following figures, like parts or portions are denoted by like numerals. The junction member 6 joins the moving coil 5, which is an air-core coil, to the arm 7.

As illustrated in FIG. 1, the swing-type actuator comprises the arm 7 formed of die-cast aluminum, a magnesium alloy or the like and the moving coil 5. The moving coil 5 is fixed to the arm 7 with an adhesive or by insert molding using a thermoplastic resin. The moving coil 5 is positioned in the magnetic gap 4 sandwiched in between the permanent magnets 2, and, when the moving coil 5 is electrified, a driving force around the shaft 8 acts on the moving coil 5, so that the arm 7 swings around the shaft 8. At that time, the smaller the gap between the moving coil 5 and the permanent magnet 2 is, the more effectively a high driving force can be obtained.

The conventional moving coil 5 is generally an air-core coil produced by providing a bond wire comprising a coated wire having an adhesive film on the surface thereof, spirally winding the bond wire into a coil while applying heat or an alcohol thereto to fuse the adhesive film and cooling the wound wire. However, in the air-core coil, the dispersion of diameter size of the above bond wire is so large that constant adjustment is required in the winding step, thereby permitting only an individual winding. Further, complete in-parallel winding is difficult, so that it is hard to render the end faces of the coil parallel with each other and, therefore, the dispersion of coil density is large. Therefore, there is raised a problem that it is not feasible to adjust the gap between the moving coil 5 and the permanent magnet 2 to a desired level whereby an effective driving force can be obtained.

Meanwhile, in Japanese Patent Appln. Laid-Open Gazette No. 99756/88 and U.S. Pat. Nos. 5,122,703, 5,165,090, 5,168,185 and 5,168,184, it is proposed to join an arm 7 to a moving coil 5 which is an air-core coil with use of a holding member according to the insert molding technique. In the above proposals, there is raised a problem that the air-core coil is deformed by the pressure under which the thermoplastic resin is charged, thereby causing maintaining the parallel relationship to be unattainable. In addition, there is raised another problem that, because of the use of the air-core coil, automatic incorporation of the coil into a metal mold in the insert molding is difficult. inevitably resulting in extremely poor productivity.

Further, when the air-core coil is attempted to be used, the positions of leads where the winding is started and where the winding is ended are indefinite, so that the electrical connection of leads to terminal pins is performed by manual operations including lead positioning and removal of its coating, binding to the terminals and soldering.

Still further. when the moving coil 5, arm 7 and terminals are positioned and joined together by bonding or integral molding, there is accompanied with a difficult manual work of burying the terminals into apertures with a pair of tweezers. In the integral molding, there are frequently by caused troubles such as floating of lead, short circuit and breaking of wire. The movable coil is an air-core coil, and, for increasing the mechanical strength of the movable coil and positioning thereof in the assembly step, two methods would be contemplated, one comprising pressing a bobbin into the air-core coil after the fitting-up of the air-core coil to effect a bond therebetween and the other comprising also effecting a bond between the coil and the bobbin within the coil with a thermoplastic resin concurrently with the integral molding of the coil and the arm. In the former method, it is likely that the bobbin flaws the coil at the time of pressing the bobbin and that the coil suffers its corrosion or a change in weight balance by the evaporation of gases from the adhesive. On the other hand, in the latter method, there is raised a problem that, after the formation of the bobbin with the resin, shrinkage and other changes with the elapse of the time occur inside to thereby weaken the adhesion of the bobbin to the coil.

FIG. 2 is a perspective view of a mechanism for positioning a magnetic head for use in the conventional magnetic disk unit. In this figure, numeral 9 denotes the mechanism for positioning a magnetic head, and numerals 10, 11, 12 and 13 denote a magnetic circuit, a supporting plate, a magnetic head and a pin for positioning, respectively.

Referring to the figure, the arm 7 of the magnetic head positioning mechanism 9 serves to hold the magnetic head 12, and the rotation shaft 8 functions as the center of rotation of the arm 7 and is fixed by the supporting plate 11. The moving coil 5 is secured to the arm 7, and the magnetic flux generated by the electrification of, or application of a current to, the moving coil 5 passes through the magnetic circuit 10. The positioning of the arm 7 is performed by the positioning pin 13.

Referring further to FIG. 2, the action of the conventional actuator will be described. Upon electrification of the coil 5 secured to the arm 7 and disposed in the magnetic circuit 10, the thus generated magnetic flux passes through the magnetic circuit 10 to induce a driving force according to the Fleming's left-hand rule thereby to rotate the arm 7 holding the magnetic head 12 about the rotation shaft 8. This rotation shaft 8 is supported by a supporting plate 11 and is pressed in or bonded to a bearing not shown.

The conventional actuator for a disk unit has the above structure, so that it is necessary to decrease the weight of the whole of the movable parts in order to decrease the moment of inertia of the movable parts which determines the level of the driving force. Accordingly, measures have been taken, such as changing the material of the above arm from aluminum (specific gravity: 2.7) to magnesium (specific gravity: 1.8). There is raised, however, a problem that there is a limit in the above decrease of the weight to thereby cause a desirable miniaturization of the driving parts to be unfeasible.

For resolving the above problem, the above U.S. patents propose to effect integral molding of the arm and the holding member for holding the moving coil with a thermoplastic resin having a longitudinal elastic modulus of at least $30\times10^4$ kg/cm$^2$. However, unfavorably, the bearing part is made of the resin, so that the strength thereof is low to thereby lower the reliability of the resultant actuator. Further, since the holding member holds the peripheral part of the moving coil consisting of a multilayer air-core coil, the injection pressure deforms the air-core coil thereby to unfavorably lower the dimensional accuracy thereof.

DISCLOSURE OF THE INVENTION

It is a first object of the present invention to provide an economically advantageous actuator for a disk unit, in which the gap between the moving coil and the permanent magnet is decreased so as to effectively obtain a driving force to swing the actuator.

It is a second object of the present invention to provide an actuator for disk units which is not only ensuring effective and stable generation of a driving force but also excellent in economy and productivity by improving the dimensional accuracy of the moving coil and by simultaneously minimizing the dimensional accuracy dispersion of products obtained by joining an arm and a moving coil together.

It is a third object of the present invention to not only reduce the weight of the arm and prevent deformation of the coil but also provide an actuator for disk units, especially magnetic disk units, which is enabled to be produced with excellent dimensional accuracy and economic advantage.

With a view to attaining the above objects, the inventors have made intensive studies and as a result, the present invention has been made.

The above first object is achieved by providing a swing-type actuator which comprises an arm and a coil bobbin which is a movable coil, a bobbin being produced by injection molding into a bobbin a thermoplastic resin (A) having a flexural modulus of at least $8\times10^2$ kgf/mm$^2$ and a heat deformation temperature of at least 200° C. under a load of 18.6 kg/cm$^2$ and winding a conductive wire around the bobbin, the arm and the bobbin being integrally bound with a junction member made of another thermoplastic resin (B).

Fundamentally, the swing-type actuator of the present invention is composed of a housing comprising a pair of yokes opposing each other and a permanent magnet fixed to at least one thereof with a magnetic gap provided on the surface of the permanent magnet, and a swingable arm having one end to which a moving coil is fixed and the other end to which a functional member such as a magnetic head is fixed, the moving coil being movably disposed in the magnetic gap.

In the prior art, the movable coil 5 is only a coil obtained by coiling a wire, particularly a coil formed simply by winding a wire appropriate times. In contrast, in the present invention, a coil bobbin formed by winding a conducting wire around a bobbin appropriate times is substituted for the movable coil 5 of the prior art. The bobbin for use in the present invention is composed of a thermoplastic resin (A). The thermoplastic resin is molded into the bobbin by the conventional injection molding technique. The arm 7 may be composed of a light metal as in the prior art, but it is preferred that the arm 7 be formed by injecting the thermoplastic resin (A) to be substituted for the conventional one of a light metal. One form of the above bobbin 14 is shown in FIG. 3.

The actuator is produced by arranging the coil bobbin (coil having a conductor wound around a bobbin) and the arm and injecting another thermoplastic resin (B) as a junction member to integrally bond the coil bobbin and the arm together by the insert molding technique. Illustratively stated, the coil bobbin (coil having a conductor wound around a bobbin) and the arm which have separately been produced, are arranged in a metal mold, and subsequently the thermoplastic resin (B) as a junction member is injected into the metal mold, thereby producing the actuator comprising the coil bobbin and the arm which are integrally bound with the junction member.

Since the higher rigidity the thermoplastic resins (A) and (B) have, the more difficultly deformable they are, it is requisite that both of the resins employed in the present invention have a flexural modulus of at least $8\times10^2$ kgf/mm$^2$ (measured in accordance with ASTM D790). Examples of resins (A) and (B) are polyamide resins such as nylon; polyacetal resins; polycarbonate resins; modified polyphenylene ethers; polyester resins such as polyethylene phthalate and polybutylene phthalate; polyphenylene sulfide resins; polysulfone resins; polyether ketone resins such as polyether ether ketone; wholly aromatic polyester resins such as polyarylates; ABS resin; polyolefin resins such as reinforcedpolypropylene; and thermotropic liquid crystal polymers such as wholly aromatic polyester-type thermotropic liquid crystal polymers.

The thermoplastic resin (A) as the insert member is brought into contact with the thermoplastic resin (B). Therefore, when the melting point of the thermoplastic resin (B) is far higher than that of the thermoplastic resin (A), the heat of the thermoplastic resin (B) deforms and in extreme cases melts the bobbin at the time of insert molding. However, even if the thermoplastic resin (B) has a somewhat high melting point, the above deformation is practically less. Thus, it is preferred that the thermoplastic resin (B) have a melting point which is, 100° C. or less, higher than the melting point of the thermoplastic resin (A).

It is requisite that the thermoplastic resin (A) for use in the formation of the bobbin for a coil have a flexural modulus of at least $8\times10^2$ kgf/mm$^2$ (measured in accordance with ASTNL D790) and a heat deformation temperature under a load of 18.6 kg/cm$^2$ of at least 200° C. (measured in accordance with ASTM D648). This is because a bobbin for a coil having a flexural modulus and a heat deformation temperature which are lower than the above given values might be deformed by the injection and holding pressures at the time of the joining of the resulting coil bobbin with the junction member according to the insert molding technique.

Taking into account the driving efficiency of the coil, it is preferred that the bobbin have a small wall thickness to decrease the weight thereof. However, for producing such a bobbin by injection molding, it is required to provide a resin which is excellent in fluidity through a thin cavity, and, in addition, the bobbin is required to have satisfactory strength even when it has a small thickness. From this viewpoint, thermotropic liquid crystal polymers are preferred as the thermoplastic resin (A).

In the case of a thin-walled coil bobbin prepared by winding a conductive wire around a thin-walled bobbin, it is likely that the coil bobbin might suffer deformation by the pressure of the wound wire or, if deformation does not occur at the time of winding, might be deformed by the heating or pressure applied at the time of insert molding or subsequent molding operation, thereby causing peeling to occur at the junction thereof with the arm. This might be attributed to the shrinking force of the thermoplastic resin (B) as the junction member, exerted at the time of solidification.

For preventing the above peeling, it is preferred to apply a thermosetting adhesive to at least the faces of the coil bobbin and the arm, which are to be brought into contact with the junction member prior to such contact. Although the types of thermosetting adhesives are not particularly limited, epoxy resin adhesives are preferred from the viewpoint of electrical properties and bond strength. Any types of epoxy resin adhesives may be used without specific limitation.

When the thermosetting adhesive has such a high viscosity that it does not flow down the coated face, the bobbin and arm thus treated are used as insert members.

On the other hand, when a thermosetting adhesive used is low in viscosity, preliminary curing thereof is effected by heating after coated. When the viscosity of the adhesive is low, mere coating would cause the adhesive to flow down the coated face to thereby be removed from the face and stain other faces. Thus, the heating at this stage is conducted only to increase the viscosity of the adhesive to a level such that the above flow does not occur. In this operation as well, the epoxy resin adhesive is preferred. For the epoxy resin adhesive, generally, the above heating is conducted at a temperature selected from the range of 100 to 200° C. for a period of time selected from the range of 10 sec to 20 min.

When the coil bobbin having so coated and heated is arranged as an insert member, followed by injection of the thermoplastic resin (B), the heat of the thermoplastic resin cures the adhesive to thereby increase the adhesion between each of the coil bobbin and arm, and the thermoplastic resin (B) as the junction member. Further, even if the coil bobbin has a small wall thickness, the occurrence of the above peeling becomes less.

In the injection molding, the injection of the molten resin is generally accomplished within a short period of time, and the injected resin is immediately cooled. Thus, sometimes, the heating is insufficient for thermally curing the adhesive, so that satisfactory bond strength cannot be obtained. For coping with the above, it is requisite that the molding temperature for the thermoplastic resin (B) to be injected be satisfactorily high. Generally, as long as the molding temperature is at least 100° C. higher than the curing temperature of the thermosetting adhesive at which the curing is conducted for 5 to 15 min as standard curing condition, the thermosetting resin as an adhesive can be satisfactorily cured even when heated for a short period of time according to the customary injection conditions to thereby realize a given bond strength. Herein, the description "curing temperature of the thermosetting adhesive at which the curing is conducted for 5 to 15 min as standard curing condition" refers to the optimum temperature at which the greatest bond strength is obtained by the heating for 5 to 15 min. It is predetermined depending on the type of the adhesive employed. For the epoxy resin adhesive, generally, it is selected from the range of 100 to 300° C.

The description "molding temperature for the thermoplastic resin (B) to be injected" refers to the temperature of melting of the resin during the molding thereof, though the temperature of the cylinder of the injection molding machine, preset for the injection molding, may be substituted for said melting temperature.

The thermotropic liquid crystal polymers preferably employed as the thermoplastic resins (A) and (B) in the present invention are resins exhibiting an optical anisotropy in the molten state and thermoplastic meltable polymers respectively. This polymer exhibiting an optical anisotropy in the molten state has a property such that the molecular chains of the polymer have regular parallel arrangement in the molten state. The properties of the optically anisotropic melt phase can be confirmed by the conventional polarimetry utilizing crossed polarizers. The general polymers exhibiting no melt anisotropy are isotropic in the molten state. However, when they exhibit anisotropy in the melting step, they change from a solid phase through an anisotropic liquid crystal phase to anisotropic phase.

Mechanical anisotropy can also be confirmed. That is, it can be confirmed by marked fibrilization and peeling on the surface of a molded article in injection molding and further by a marked difference in properties between the direction of flow of the resin and the direction perpendicular thereto.

The resin exhibiting an optical anisotropy in the molten state is generally known as the thermotropic liquid crystal polymer. This thermotropic liquid crystal polymer is generally produced from a monomer which is slender, flat, and highly rigid along the principal molecular chain and which has a plurality of chain propagation bonds being in either coaxial or parallel relationship.

The polymer exhibiting an optical anisotropy in the molten state has a property such that the molecular chains of the polymer have regular parallel arrangement in the molten state. The properties of the optically anisotropic melt phase can be confirmed by the conventional polarimetry utilizing crossed polarizers.

The above thermotropic liquid crystal polymer is preferably a thermotropic liquid crystal polyester. This may be selected from among various liquid crystal polyesters and liquid crystal polyester imides, such as partially or wholly aromatic polyesters, polyester amides and polyester carbonates. The above polyesters comprehend any polymer having a plurality of ester bonds. Among them, aromatic polyesters are especially preferred.

The thermotropic liquid crystal polyesters for use in the present invention comprehend a polyester composed of a polymer chain of which a part is composed of a segment that can form an anisotropic melt phase while the remaining part is composed of a segment that cannot form an isotropic melt phase. They also comprehend a compound polymer prepared by compounding plural thermotropic liquid crystal polyesters.

Representative examples of the monomers for use in the formation of the thermotropic liquid crystal polyesters are:

(a) at least one member selected from aromatic dicarboxylic acids, (b) at least one member selected from aromatic hydroxycarboxylic acid compounds, (c) at least one member selected from aromatic diol compounds, (d) at least one member selected from aromatic dithiol ($d_1$), aromatic thiophenol ($d_2$) and aromatic thiol carboxylic acid ($d_3$) compounds, and (e) at least one member selected from aromatic hydroxyamine and aromatic diamine compounds.

In the polymerization, the monomers of the groups (a) through (e) above may be individually employed. However, in many cases, these are employed in combination, e.g., combinations of groups (a) and (c), groups (a) and (d), groups (a), (b) and (c), groups (a), (b) and (e), or groups (a), (b), (c) and (e).

Examples of the aromatic dicarboxylic acid compounds of the group (a) above are aromatic dicarboxylic acids such as terephthalic acid, 4,4'-diphenyldicarboxylic acid, 4,4'-triphenyl-dicarboxylic acid, 2,6-naphthalendicarboxylic acid, 1,4-naphthalendicarboxylic acid, 2,7-naphthalenedicarboxylic acid, diphenyl ether 4,4'-dicarboxylic acid, diphenoxyethane-4,4'-dicarboxylic acid, diphenoxybutane-4,4'-dicarboxylic acid, diphenylethane-4,4'-dicarboxylic acid, isophthalic acid, diphenyl ether 3,3'-dicarboxylic acid, diphenoxyethane-3,3'-dicarboxylic acid, diphenylethane-3,3'-dicarboxylic acid and 1,6-naphthalenedicarboxylic acid; and products of substitution of the above aromatic dicarboxylic acids with an alkyl, an alkoxy or a halogen, such as chloroterephthalic acid, dichloroterephthalic acid, bromoterephthalic acid, methylterephthalic acid, dimethylterephthalic acid, ethylterephthalic acid, methoxyterephthalic acid and ethoxyterephthalic acid.

Examples of the aromatic hydroxycarboxylic acid compounds of the group (b) above are aromatic hydroxycarboxylic acids, such as 4-hydroxybenzoic acid, 3-hydroxybenzoic acid, 6-hydroxy-2-naphthoic acid and 6-hydroxy-1-naphthoic acid, and products of substitution of the above aromatic hydroxycarboxylic acids with an alkyl, an alkoxy or a halogen, such as 3-methyl-4-hydroxy-benzoic acid, 3,5-dimethyl-4-hydroxybenzoic acid, 2,6-dimethyl-4-hydroxybenzoic acid, 3-methoxy-4-hydroxybenzoic acid, 3,5-dimethoxy-4-hydroxybenzoic acid, 6-hydroxy-5-methoxy-2-naphthoic acid, 2-chloro-4-hydroxybenzoic acid, 3-chloro-4-hydroxybenzoic acid, 2,3-dichloro-4-hydroxybenzoic acid, 3,5-dichloro-4-hydroxybenzoic acid, 2,5-dichloco-4-hydroxybenzoic acid, 3-bromo-4-hydroxybenzoic acid, 6-hydroxy-5-chloro-2-naphthoic acid, 6-hydroxy-7-chloro-2-naphthoic acid and 6-hydroxy-5,7-dichloco-2-naphthoic acid.

Examples of the aromatic diol compounds of the group (c) above are aromatic diols, such as 4,4'-dihydroxydiphenyl, 3,3'-dihydroxydiphenyl, 4,4'-dihydroxytriphenyl, hydroquinone, resorcinol, 2,6-naphthalenediol, 4,4'-dihydroxydiphenyl ether, bis(4-hydroxyphenoxy)ethane, 3,3'-dihydroxydiphenyl ether, 1,6-naphthalenediol, 2,2-bis(4-hydroxyphenyl)-propane and bis(4-hydroxyphenyl) methane, and products of substitution of the above aromatic diols with an alkyl, an alkoxy or a halogen, such as chlorohydroquinone, methylhydroquinone, t-butylhydroquinone, phenylhydroquinone, methoxyhydroquinone, phenoxy-hydroquirone, 4-chlororesorcinol and 4-methyl-resorcinol.

Examples of the aromatic dithiol compounds of the group ($d_1$) above are benzene-1,4-dithiol, benzene-1,3-dithiol, 2,6-naphthalene-dithiol and 2,7-naphthalene-dithiol.

Examples of the aromatic thiophenol compounds of the group ($d_2$) above are 4-mercaptophenol, 3-mercaptophenol and 6-mercaptophenol.

Examples of the aromatic thiol carboxylic acid compounds of the group ($d_3$) above are 4-mercapto-benzoic acid, 3-mercapto-benzoic acid, 6-mercapto-2-naphthoic acid and 7-mercapto-2-naphthoic acid.

Examples of the aromatic hydroxyamine and aromatic diamine compounds of the group (e) above are 4-aminophenol, N-methyl-4-aminophenol, 1,4-phenylenediamine, N-methyl-1,4-phenylenediamine, N,N'-dimethyl-1,4-phenylenediamine, 3-aminophenol, 3-methyl-4-aminophenol, 2-chloro-4-aminophenol, 4-amino-1-naphthol, 4-amino-4'-hydroxydiphenyl, 4-amino-4'-hydroxydiphenyl ether, 4-amino-4'-hydroxydiphenylmethane, 4-amino-4'-hydroxydiphenyl sulfide, 4,4'-diaminophenyl sulfide (thiodianiline), 4,4'-diaminodiphenyl sulfone, 2,5-diaminotoluene, 4,4'-ethylenedianiline, 4,4'-diaminodiphenoxyethane, 4,4'-diaminodiphenylmethane (methylenedianiline) and 4,4'-diaminodiphenyl ether (oxydianiline).

The thermotropic liquid crystal polyesters for use in the present invention can be produced from the above monomers by the use of various esterification techniques including the melt acidolysis and slurry polymerization processes.

The molecular weights of thermotropic liquid crystal polyesters suitable for use in the present invention are each in the range of about 2000 to 200,000, preferably about 4000 to 100,000. The molecular weights of the above-mentioned compounds may be determined by various methods including one in which a compressed film is prepared and the terminal groups of the film are determined by infrared spectroscopy, and another in which GPC being the common measuring method is performed after the preparation of a solution of the compound.

Aromatic homo- or copolyesters each containing the monomer unit represented by the following general formula (1) as an essential component are preferred among the thermotropic liquid crystal polymers obtainable from the above monomers. It is preferred that this monomer unit be contained in each of the polymers in an amount of at least about 50% by mole.

(1)

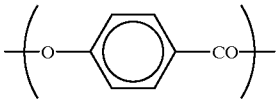

The aromatic polyester especially preferred for use in the present invention is one having the repeating units with structures respectively derived from three different compounds, i.e., p-hydroxybenzoic acid, phthalic acid and biphenol and represented by the following formula (2). In this polyester represented by the following formula (2), the repeating units each having a structure derived from biphenol may partially or wholly be replaced by the repeating units derived from dihydroxybenzene. Further, the aromatic polyester also especially preferred for use in the present invention is one having the repeating units with structures respectively derived from two different compounds, i.e., p-hydroxybenzoic acid and hydroxynaphthalene-carboxylic acid and represented by the following formula (3).

(2)

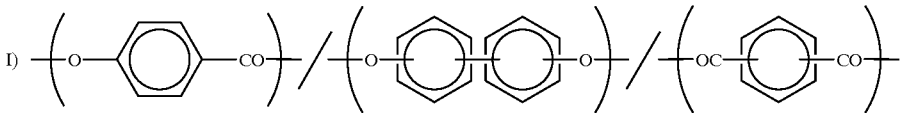

-continued (3)

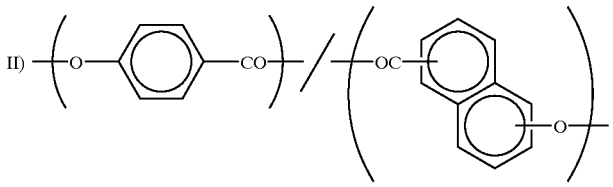

In the present invention the thermotropic liquid crystal polymers may be used either individually or in combination.

The thermotropic liquid crystal polymer may be blended with a "non-liquid crystal" resin prior to use. The blendable resin may be a thermoplastic or thermosetting one. As preferred examples of the blendable resins, there may be mentioned resins known as thermoplastic engineering plastics, such as polyamide, polycarbonate, polyethylene terephthalate, polybutylene terephthalate, polyphenylene sulfide, polyether sulfone. polysulfone, polyether ketone and polyether ether ketone resins. These thermoplastic resins may each be blended in an amount of 1 to 200 parts by weight; preferably 1 to 100 parts by weight, more preferably 1 to 50 parts by weight per 100 parts by weight of the thermotropic liquid crystal polymer for use in the present invention.

Further, a reinforcement or filler may be added to the thermotropic liquid crystal polymer for use in the present invention in order to improve the heat resistance and mechanical properties thereof. The reinforcement or filler may be, for example, a fibrous or particulate material or a mixture thereof. Examples of suitable fibrous reinforcements are inorganic fibers, such as glass, Shirasu (powdered pumice)/glass, alumina, silicon carbide, ceramic, asbestos, gypsum and metallic (e.g., stainless steel) fibers, and carbon fibers. Examples of suitable particulate reinforcements are silicates such as wollastonite, sericite, kaolin, mica, clay, bentonite, asbestos, talc and aluminosilicate; metallic oxides such as alumina, silicon oxide, magnesium oxide, zirconium oxide and titanium oxide; carbonates such as potassium carbonate, magnesium carbonate and dolomite; sulfates such as calcium sulfate and barium sulfate; calcium pyrophosphate; glass beads; boron nitride; silicon carbide; and sialon. These may be hollow (e.g., hollow glass fibers, glass microballoons, Shirasu balloons and carbon balloons). The above reinforcements may be pretreated with a silane- or titanium-based coupling agent if necessary.

Still further, as far as the objects of the present invention are not impaired, various conventional additives may be added to the thermotropic liquid crystal polymer for use in the present invention in order to impart intended properties thereto. Examples of such conventional additives are an antioxidant and heat stabilizer (e.g., hindered phenol, hydroquinone, phosphites and derivatives thereof), an ultraviolet absorber (e.g., resorcinol, salicylates, benzotriazole and benzophenone), a lubricant and releasing agent, a dye (e.g., nitrosine), a colorant containing a pigment (e.g., cadmium sulfide, phthalocyanine and carbon black), a flame retardant, a plasticizer and an antistatic agent. The reinforcement or filler may be added in an amount of up to 80% by weight, preferably up to 70% by weight of the total of the resins.

In the injection molding of the thermotropic liquid crystal polymer, the injection may be carried out under the conditions such that the temperature of the resin is in the range of 200 to 420° C., the temperature of the metal mold in the range of 60 to 170° C., preferably 60 to 130° C., the injection pressure in the range of 1 to 200 kg/cm$^2$ and the injection speed in the range of 5 to 500 mm/sec.

In order to attain the second object mentioned hereinbefore, the present invention provides an actuator for a disk unit comprising a head as a functional member, an arm supporting the head and a movable coil acting in a magnetic circuit, wherein the movable coil is composed of a coil bobbin comprising a bobbin produced by molding a thermoplastic resin, and a lead wound around the bobbin, and wherein the bobbin has terminal pins for electrical connection to the starting and finishing ends of the coil wire.

The present invention further provides an actuator for a disk unit comprising a head as a functional member, an arm supporting the head and a movable coil acting in a magnetic circuit, wherein the movable coil is composed of a coil bobbin comprising a bobbin produced by molding a thermoplastic resin, and a lead wound around the bobbin to form a coil, and wherein the bobbin has grooves provided in parts of its body which are brought into contact with the coil wire.

FIG. 4(*a*) is a side elevation showing one form of the bobbin of the swing-type actuator according to the present invention, and FIG. 4(*b*) a plan showing the same. Numerals 15 and 16 denote a terminal block and terminal pins, respectively. FIG. 5(*a*) is a plan showing one form of the swing-type actuator of the present invention, and FIG. 5(*b*) a view showing a longitudinal section of the same. The like numerals in FIGS. 1 to 4 denote the like parts or portions.

Referring particularly to FIGS. 4 and 5, the movable coil 5 is composed of a coil bobbin comprising a bobbin 14 produced by molding a thermoplastic resin, and a coil wire wound around the bobbin. The employment of the above coil bobbin not only improves the dimensional accuracy of the movable coil 5 but also permits automatic setting of the movable coil in the metal mold at the time of insert molding to thereby greatly improve the productivity. Further, it permits the use of aluminum and magnesium alloys and thermoplastic resins for formation of the arm 7.

The thermoplastic resin to be employed is as set forth above, and especially preferred is the thermotropic liquid crystal polymer. The thermoplastic resin may be blended with the above various additives, such as a reinforcement, a filler, an antioxidant and a heat stabilizer.

The movable coil 5 shown in FIG. 5 is generally produced by providing a bond wire comprising an insulated coated wire having an adhesive film on the surface thereof and subsequently spirally winding the wire into a coil while bonding the same by applying heat or an alcohol to fuse or dissolve the adhesive film.

The bobbin 14 is desirably provided with grooves on the outer surface of the body thereof as shown in FIG. 4(*a*). Whether or not the winding of the wire into a coil is successful greatly depends on the state of the first layer of the wire wound in a coil. Providing the grooves each capable of accommodating the maximal diameter among dispersed wire diameters and effecting forced winding at given positions to thereby form the first layer of wound wire facilitates the realization of winding in a complete coil, increases and stabilizes the wire density and stabilizes the parallelism of the coil. Further, it minimizes the regulation work for coping with wire diameter changes, and permits streamlining of the winding step by simultaneous multispool winding.

The bobbin 14 is provided with a pin terminal block 15 as shown in FIGS. 4(*a*) and (*b*). This pin terminal block is provided with terminal pins 16. The terminal pins 16 are provided either by insert molding concurrently with the molding of the bobbin 14 or by mechanically driving in after the molding of the bobbin. In the present invention. the pin terminal block is not necessarily provided, as long as the terminal pins 16 can be fixed to the bobbin 14. The terminal pins 16 are electrically connected to the starting and finishing ends of the coil wire (not shown). Providing the pin terminal block is preferred because it also serves as a locking member at the time of joining the arm to the coil.

In the wire winding around the above bobbin provided with the terminal pins, the tying and the soldering can be performed by automatic machines, so that the positioning of leads is rendered specific. Further, in the integral molding of the movable coil 5 and the arm 7, the positions of the terminals are automatically determined by the positioning of the bobbin 14, so that the manual work for the pins per se with tweezers becomes unnecessary to thereby achieve automation. Thus, not only a copper wire but also an aluminum wire having poor strength can be used as the coil wire.

Wire winding can be performed after the lapse of a certain period of time after the formation of the bobbin 14, so that there can be prevented the lowering of the bond strength between the bobbin 14 and the movable coil 5 caused by variation with the lapse of time attributed to the shrinkage of the resin, etc.

Leads (not shown) reaching the terminal pins 16 provided on the pin terminal block 15 and electrically connected to the starting and finishing ends of the coil wire of the movable coil 5 can be prevented from causing floating of the leads, short circuit or breaking thereof at the time of integral molding of the movable coil 5 and the arm 7 by forming blind grooves (not shown) for protection on the bobbin.

The movable coil 5 and the arm 7 are preferably integrally fixed by disposing them in a metal mold and subsequently injecting thereinto a thermoplastic resin having an appropriate melt viscosity as a junction member.

The thermoplastic resin (B) for use as the junction member preferably has an apparent viscosity of $2\times10^3$ poise or less, as determined at a shear rate of $10^3$ $sec^{-1}$ and at the melting point plus 30° C., the melting point being measured by DSC, or the glass transition temperature plus 150° C. When the thermoplastic resin (B) has a viscosity higher than the above, the resin injection pressure required at the time of injection molding is so high that there is the danger of coil deformation. Examples of the preferred thermoplastic resins (B) are as previously mentioned.

Thus, there is obtained the swing-type actuator comprising the arm 7 and bobbin 14 integrally fixed with the junction member 6 so that the pin terminal block and part of the bobbin are enclosed in the junction member as shown in FIGS. 5(*a*) and 5(*b*).

The employment, as a movable coil, of a coil bobbin comprising a bobbin produced by molding a thermoplastic resin, and a lead wound around the bobbin to form a coil, according to the present invention not only improves the dimensional accuracy of the movable coil but also permits automatic setting of the movable coil in a metal mold at the time of insert molding to thereby greatly improve the productivity. When the bobbin is used, the arm is joined to the bobbin, so that it is not particularly required to hold the periphery of the coil with a holding member.

Providing the body of the bobbin with the grooves facilitates the realization of complete winding in a coil, stabilizes the wire density at an increased level and stabilizes the parallelism of the coil, thereby to minimize the regulation work for coping with wire diameter changes and permit streamlining of the winding step by simultaneous multispool winding.

Further, the positioning of leads, removal of coating, tying and soldering in the winding step can be automated by providing the bobbin with terminal pins.

Simultaneous wire winding can be conducted around a number of bobbins, and, when the coil bobbin and the arm are integrally fixed with a specific thermoplastic resin, the manual work for positioning the terminals can be obviated because the terminals are automatically positioned by the positioning of the coil bobbin.

The step of pressing a bobbin into the inside of the coil and bonding them for strengthening the coil and for positioning in the assembly step can be obviated, so that the danger of flawing the coil by the pressing of the bobbin and causing corrosion by gas evaporated from the employed adhesive can be avoided.

For attaining the above third object, the present invention provides actuator for a disk unit comprising a head as a functional member, an arm supporting the head and a movable coil acting in a magnetic circuit, the arm being adapted to conduct a swing motion about the axis of rotation so as to position the head, wherein the actuator is further provided with a cylindrical bearing of a metal, the movable coil is composed of a coil bobbin having a coil wire wound around a bobbin, the arm is formed of a thermoplastic resin, and the bearing, the arm and the movable coil are integrally fixed with a thermoplastic resin.

FIG. 6 is a perspective view of one form of a bearing 17. In the present invention, the bearing 17 is composed of a cylindrical metal. This metal is, for example, stainless steel or the like, which is preferred from the viewpoint of required small thickness and high strength. The employment of such a cylindrical metal bearing ensures improved strength and markedly increased reliability. In particular, FIG. 6(*a*) shows a flanged bearing while FIG. 6(*b*) shows a flangeless bearing.

FIG. 7 is a perspective view of arms 7 in each of which an aperture 17*b* for fitting the bearing 17 therein is perforated. FIG. 8 is a perspective view of a coil bobbin. For example, three sheets for an arm 7 as shown in FIG. 7 are laminated together for use in the present invention. An air-core coil, etc., may be used as the movable coil, and there is no particular limitation with respect to the movable coil. However, a coil bobbin comprising a bobbin 14 having a coil wire wound therearound as shown in FIG. 8 is preferably employed. The employment of such a coil bobbin eliminates the drawback that the injection pressure deforms the coil to thereby lower the dimensional accuracy. The bobbin 14 is provided with a fitting piece 18 for fitting the bobbin to the bearing 17, which fitting piece is molded either integrally with the bobbin 14 or separately.

In the present invention, the arm 7 and the bobbin 14 are each formed of a thermoplastic resin. The specific gravity of the thermoplastic resin is appropriately selected taking into account the balance of the whole of the actuator. From the viewpoint of a reduction in weight, it is preferred that the specific gravity of the thermoplastic resin be 1.7 or lower.

In particular, it is preferred that the thermoplastic resin for forming the arm 7 have a linear expansion coefficient of $3\times10^{-5}$/° C. or less, an elastic modulus of at least $8\times10^{2}$ kgf/mm$^2$ and a loss factor of at least 0.01. The employment of the above thermoplastic resin permits reduction of the weight of the arm, and provides the arm with excellent dimensional stability, rigidity sufficient to support the magnetic head and excellent damping properties for vibration. The product thickness of the arm can be decreased for reduction of the weight thereof, depending on the elastic modulus of the resin.

The above preferred thermoplastic resin may be obtained by making appropriate selection from among the resins set forth previously and by selecting a suitable inorganic filler to be added to the resin.

FIGS. 9(*a*) and (*b*) are a plan and a side elevation, respectively, showing the state of the arm 7 and the coil bobbin 14 which are set in the flanged bearing 17 shown in FIG. 6(*a*). The bearing fitting aperture 17*a* has one side open greater than the other side so that the above flanged bearing 17 can be passed therethrough. The flanged bearing 17 is fitted in the bearing fitting aperture 17*a* with a play. In this arrangement, the arm 7, the coil bobbin 14 and the flanged bearing 17 are tentatively set in a metal mold for injection molding (not shown), and integrally fixed with a thermoplastic resin 19 as shown in FIGS. 10 and 11. This integral binding leads to excellent accuracy because the positional accuracies of the arm and the coil are ensured around the bearing. That is, when the bearing 17 is disposed at a given position in a metal mold and integral binding is effected with the thermoplastic resin 19, the thermoplastic resin also enters the interstice of the bearing fitting aperture 17*a* to thereby integrally bind the arm 7 and the coil bobbin 14 around the bearing 17 with excellent accuracy.

FIGS. 10(*a*) and (*b*) are a plan and a side elevation, respectively, showing an actuator for a magnetic disk unit according to one embodiment of the present invention. For the incorporation in the actuator, more than three arms 7 as shown in FIG. 7 may be laminated and bonded together, as shown in a side elevation of FIG. 11. In the actuators of FIGS. 10 and 11, the arm and the bobbin are fixed together so that part of the bobbin is enclosed in the thermoplastic resin.

BRIEF DESCRIPTION OF THE DRAWINGS

FIG. 5 is a plan and side elevation of one form of the swing-type actuator according to the present invention;

FIG. 6 is a perspective view of one form of the bearing for use in the present invention;

BEST MODE FOR CARRYING OUT THE INVENTION

The present invention will now be described in greater detail with reference to the following Examples which do not limit the scope of the invention but show preferred embodiments of the invention.

EXAMPLE 1

Figure 3:
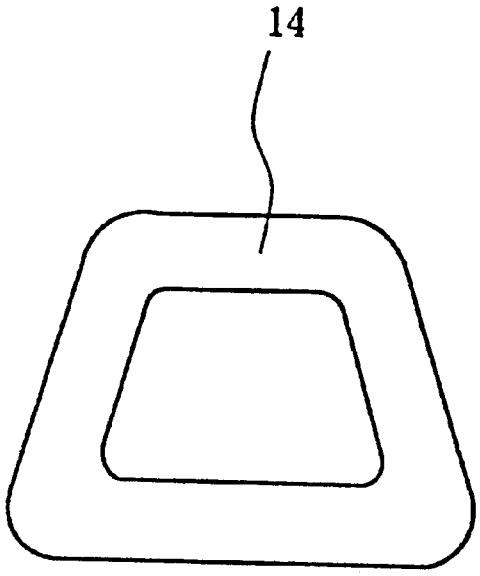
FIG. 3 is a plan and sectional view of the coil bobbin for use in the present invention.
Figure 3:
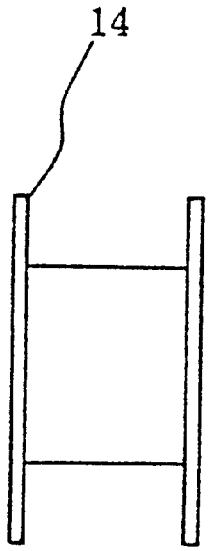

A polybutylene terephthalate resin having a flexural modulus of 900 kg/mm$^2$ and a heat deformation temperature of 210° C. under a load of 18.6 kg/cm$^2$ (trade name: 1101G-30, produced by Toray Industries, Inc.), as the thermoplastic resin (A), was injection molded at a molding temperature (temperature of the cylinder of the injection molding machine) of 250° C. to obtain a bobbin as shown in FIG. 3. A lead or conductive wire having a diameter of 0.5 mm was wound around the body of the bobbin to form about 10 turns of the wire thereon thereby to obtain a coil bobbin, and a thermosetting epoxy resin adhesive (trade name: 353 ND, produced by Epotec Technology Corp.) was applied to part of the thus obtained coil bobbin to be brought into contact with a junction member. The standard curing conditions for the epoxy resin adhesive were 120° C. and 5 min.

Figure 1:
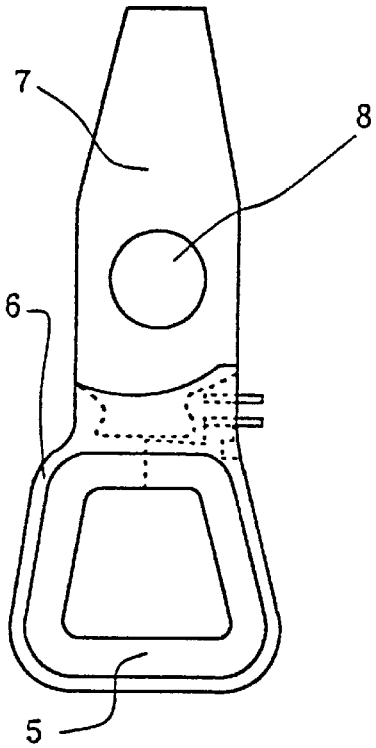
PRIOR ART Fig. 1 (a)
FIG. 1 is a schematic plan and sectional view of the conventional swing-type actuator.
Figure 1:
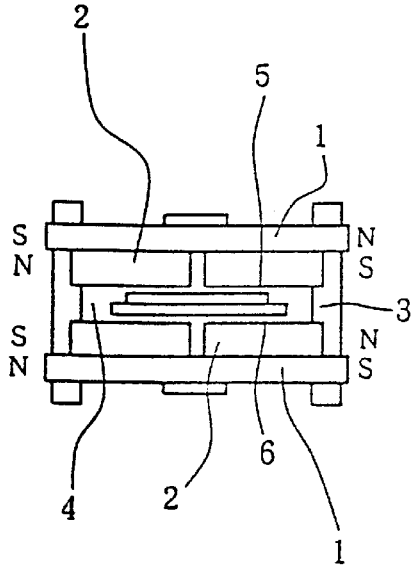
PRIOR ART Fig. 1 (b)
Figure 2:
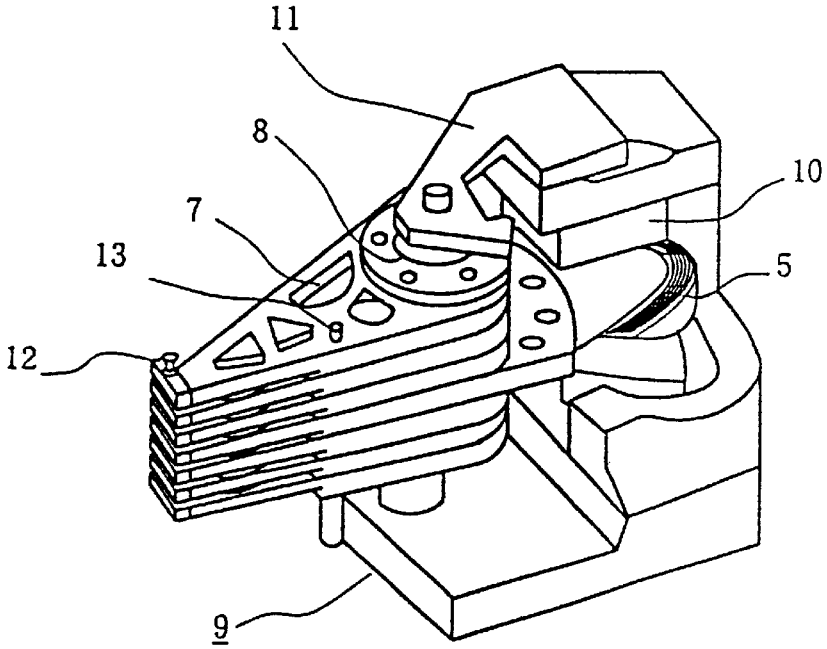
FIG. 2 is a perspective view of the conventional swing-type actuator for a magnetic disk unit.

Subsequently, the obtained coil bobbin and a separately prepared aluminum die-cast arm which were insert members, were set in a metal mold, and a thermoplastic resin (B) as the junction member was injected to conduct the conventional insert molding, thereby obtaining an actuator having a configuration as shown in FIG. 1. The temperature of the cylinder of the injection molding machine was 350° C. As the thermoplastic resin (B) for forming the junction member, there was used a thermotropic liquid crystal polymer having a flexural modulus of 1200 kg/mm$^2$ and a heat deformation temperature of 266° C. under a load of 18.6 kg/cm$^2$ (trade name: G-330, produced by Nippon Petrochemicals Co., Ltd.). The thermotropic liquid crystal polymer is a wholly aromatic polyester-type thermotropic liquid crystal polymer. The repeating units with structures of the wholly aromatic polyester-type thermotropic liquid crystal polymer are represented by the general formula (2) respectively.

The resultant molding was evaluated for the dimensional error thereof and the presence or absence of any peeling therein. The dimensional error was defined as an average value obtained by firmly stationing the arm of the molding on a Hat surface, then measuring the clearance between the flange of the coil bobbin and the Hat surface at about 10 points along the circumference of the coil bobbin and calculating an average of the differences (tolerances) of the measurements from the standard distance (design value). The peeling was evaluated by observing the interface at which the thermoplastic resin (A) joined the thermoplastic resin (B) through a magnifying glass of 10 magnifications. The results are shown in Table 1.

EXAMPLE 2

A polyphenylene sulfide resin having a flexural modulus of 1400 kg/mm$^2$ and a heat deformation temperature of 260° C. under a load of 18.6 kg/cm$^2$ (trade name: Ryton R-4, produced by Phillips Petroleum Co.), as the thermoplastic resin (A), was injection molded at a molding temperature (temperature of the cylinder of the injection molding machine) of 340° C. to obtain a bobbin as shown in FIG. 3. A lead having a diameter of 0.5 mm was wound around the body of the bobbin to make about 10 turns of the wire thereon thereby obtaining a coil bobbin, and a thermosetting epoxy resin adhesive (trade name: A164-1, produced by Grace Japan KK) was applied to part of the thus obtained coil bobbin to be brought into contact with a junction member. The standard curing conditions for the epoxy resin adhesive were 160° C. and 10 min.

Subsequently, the obtained coil bobbin and a separately prepared aluminum die-cast arm as insert members were set in a metal mold, and a thermoplastic resin (B) as the junction member was injected to conduct the conventional insert molding, thereby obtaining an actuator having a configuration as shown in FIG. 1. The temperature of the cylinder of the injection molding machine was 350° C. As the thermoplastic resin (B) for forming the junction member, there was used the same thermotropic liquid crystal polymer as used in Example 1.

The resultant molding was evaluated for the dimensional error thereof and the presence or absence of any peeling therein in the same manner as in Example 1. The results are shown in Table 1.

EXAMPLE 3

A 4, 6 nylon having a flexural modulus of 1100 kg/mm$^2$ and a heat deformation temperature of 260° C. under a load of 18.6 kg/cm$^2$ (trade name: N2030, produced by Teijin Ltd.), as the thermoplastic resin (A), was injection molded at a molding temperature (temperature of the cylinder of the injection molding machine) of 310° C. to obtain a bobbin as shown in FIG. 3. A lead having a diameter of 0.5 mm was wound around the body of the bobbin to form about 10 turns of the wire thereon, and the same thermosetting epoxy resin adhesive as used in Example 2 was applied to part of the coil bobbin to be brought into contact with a junction member.

Subsequently, the obtained coil bobbin and a separately prepared aluminum die-cast arm as insert members were set in a metal mold, and a thermoplastic resin (B) as the junction member was injected to conduct the conventional insert molding, thereby obtaining an actuator having a configuration as shown in FIG. 1. The temperature of the cylinder of the injection molding machine was 350° C. As the thermoplastic resin (B) for forming the junction member, use was made of the same thermotropic liquid crystal polymer as used in Example 1.

The resultant molding was evaluated for the dimensional error thereof and the presence or absence of any peeling therein in the same manner as in Example 1. The results are shown in Table 1.

EXAMPLE 4

A thermotropic liquid crystal polymer of wholly aromatic polyester having a flexural modulus of 1500 kg/mm$^2$ and a heat deformation temperature of 240° C. under a load of 18.6 kg/cm$^2$ (Trade name: A 130, produced by Polyplastics Co., Ltd.), as the thermoplastic resin (A), was injection molded at a molding temperature (temperature of the cylinder of the injection molding machine) of 300° C. to obtain a bobbin as shown in FIG. 3. The repeating units with structures of the thermotropic liquid crystal polymer of wholly aromatic polyester are represented by the general formula (3) respectively. A lead having a diameter of 0.5 mm was wound around the body of the bobbin to form about 10 turns of the wire thereon thereby obtaining a coil bobbin.

Subsequently, the obtained coil bobbin and a separately prepared aluminum die-cast arm as insert members were set in a metal mold, and a thermoplastic resin (B) as the junction member was injected to conduct the conventional insert molding, thereby obtaining an actuator having a configuration as shown in FIG. 1. The temperature of the cylinder of the injection molding machine was 350° C. As the thermoplastic resin (B) for forming the junction member, use was made of the same thermotropic liquid crystal polymer as used in Example 1. No thermosetting epoxy resin adhesive was applied.

The resultant molding was evaluated for the dimensional error thereof and the presence or absence of any peeling therein in the same manner as in Example 1. The results are shown in Table 1.

EXAMPLE 5

A wholly aromatic polyester-type thermotropic liquid crystal polymer having a flexural modulus of 1200 kg/mm$^2$ and a heat deformation temperature of 266° C. under a load of 18.6 kg/cm$^2$ (trade name: G-330, produced by Nippon Petrochemicals Co., Ltd.), as the thermoplastic resin (A), was injection molded at a molding temperature (temperature of the cylinder of the injection molding machine) of 350° C. to obtain a bobbin as shown in FIG. 3. The wholly aromatic polyester-type thermotropic liquid crystal polymer is the same as the thermoplastic resin (B) used in Example 1. A lead having a diameter of 0.5 mm was wound around the body of the bobbin to form about 10 turns of the wire thereon thereby obtaining a coil bobbin.

Subsequently, the obtained coil bobbin and a separately prepared aluminum die-cast arm as insert members were set in a metal mold, and a thermoplastic resin (B) as the junction member was injected to conduct the conventional insert molding, thereby obtaining an actuator having a configuration as shown in FIG. 1. The temperature of the cylinder of the injection molding machine was 350° C. As the thermoplastic resin (B) for forming the junction member, use was made of the same thermotropic liquid crystal polymer as resin (B) used in Example 1. No thermosetting epoxy resin adhesive was applied.

The resultant molding was evaluated for the dimensional error thereof and the presence or absence of any peeling therein in the same manner as in Example 1. The results are shown in Table 1.

EXAMPLE 6

A wholly aromatic polyester-type thermotropic liquid crystal polymer having a flexural modulus of 1200 kg/mm$^2$ and a heat deformation temperature of 266° C. under a load of 18.6 kg/cm$^2$ (trade name: G-330, produced by Nippon Petrochemicals Co., Ltd.), as the thermoplastic resin (A), was injection molded at a molding temperature (temperature of the cylinder of the injection molding machine) of 350° C. to obtain a bobbin as shown In FIG. 3. The wholly aromatic polyester-type thermotropic liquid crystal polymer is the same as the thermoplastic resin (B) used in Example 1. A lead having a diameter of 0.5 mm was wound around the body of the bobbin to form about 10 turns of the wire thereon, and a thermosetting epoxy resin adhesive (trade name: A401, produced by Grace Japan KK) was applied to part of the coil bobbin to be brought into contact with a junction member. The standard curing conditions for the epoxy resin adhesive were 180° C. and 5 min.

Subsequently, the obtained coil bobbin and a separately prepared aluminum die-cast arm as insert members were set in a metal mold, and a thermoplastic resin (B) as the junction member was injected to conduct the conventional insert molding, thereby obtaining an actuator having a configuration as shown in FIG. 1. The temperature of the cylinder of the injection molding machine was 350° C. As the thermoplastic resin (B) for forming the junction member, use was made of a polyphenylene sulfide resin having a flexural modulus of 1400 kg/mm$^2$ and a heat deformation temperature of 260° C. under a load of 18.6 kg/cm$^2$ (trade name: Ryton R-4, produced by Phillips Petroleum Co.).

The resultant molding was evaluated for the dimensional error thereof and the presence or absence of any peeling therein in the same manner as in Example 1. The results are shown in Table 1.

COMPARATIVE EXAMPLE 1

A polybutylene terephthalate resin having a flexural modulus of 500 kg/mm$^2$ and a heat deformation temperature of 206° C. under a load of 18.6 kg/cm$^2$ (trade name: 1206G-15, produced by Toray Industries, Inc.), as the thermoplastic resin (A), was injection molded at a molding temperature (temperature of the cylinder of the injection molding machine) of 230° C. to obtain a bobbin as shown in FIG. 3. A lead having a diameter of 0.5 mm was wound around the body of the bobbin to form about 10 turns of the wire thereon thereby obtaining a coil bobbin, and the same thermosetting epoxy resin adhesive as used in Example 2 was applied to part of the coil bobbin to be brought into contact with a junction member.

Subsequently, the obtained coil bobbin and a separately prepared aluminum die-cast arm which were insert members, were set in a metal mold, and a thermoplastic resin (B) as the junction member was injected to conduct the conventional insert molding, thereby obtaining an actuator having a configuration as shown in FIG. 1. The temperature of the cylinder of the injection molding machine was 350° C. As the thermoplastic resin (B) for forming the junction member, there was used the same thermotropic liquid crystal polymer as used in Example 1.

The resultant molding was evaluated for the dimensional error thereof and the presence or absence of any peeling therein in the same manner as that of Example 1. The results are shown in Table 1.

COMPARATIVE EXAMPLE 2

A wholly aromatic polyester-typed thermotropic liquid crystal polymer having a flexural modulus of 900 kg/mm$^2$ and a heat deformation temperature of 190° C. under a load of 18.6 kg/cm$^2$ (trade name: A 950, produced by Polyplastics Co., Ltd.), as the thermoplastic resin (A), was injection molded at a molding temperature (temperature of the cylinder of the injection molding machine) of 300° C. to obtain a bobbin as shown in FIG. 3. A lead having a diameter of 0.5 mm was wound around the body of the bobbin to form about 10 turns of the wire thereon thereby obtaining a coil bobbin, and the same thermosetting epoxy resin adhesive as used in Example 1 was applied to part of the coil bobbin to be brought into contact with a junction member.

Subsequently, the obtained coil bobbin and a separately prepared aluminum die-cast arm as insert members were set in a metal mold. and a thermoplastic resin (B) as the junction member was injected to conduct the conventional insert molding, thereby obtaining an actuator having a configuration as shown in FIG. 1. The temperature of the cylinder of the injection molding machine was 350° C. As the thermoplastic resin (B) for forming the junction member, use was made of the same thermotropic liquid crystal polymer as used in Example 1.

The resultant molding was evaluated for the dimensional error thereof and the presence or absence of any peeling therein in the same manner as in Example 1. The results are shown in Table 1.

TABLE 1

| Ex./ Comp. Ex. No. | Configuration of bobbin | Dimensional error (mm) av. difference | peeling |
|---|---|---|---|
| Ex. 1 | Bobbin 1 | 0.08 | ○ |
| Ex. 2 | Bobbin 1 | 0.05 | ○ |
| Ex. 3 | Bobbin 1 | 0.06 | ○ |
| Ex. 4 | Bobbin 1 | 0.03 | ○ |
| Ex. 5 | Bobbin 1 | 0.03 | ○ |
| Ex. 6 | Bobbin 2 | 0.04 | ○ |
| Comp. Ex. 1 | Bobbin 1 | 0.15 | ○ |
| Comp. Ex. 2 | Bobbin 2 | 0.12 | ○ |

*Bobbin 1: thickness of flange = 0.4 mm
*Bobbin 2: thickness of flange = 0.18 mm
*= absence

EXAMPLES 7 TO 9 AND COMPARATIVE EXAMPLE 3

Figure 4:
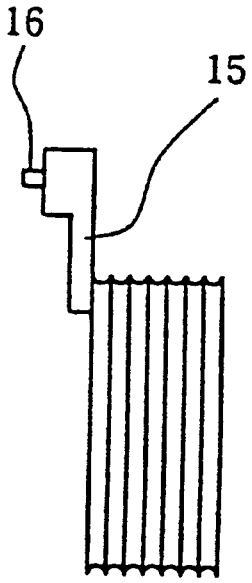
FIG. 4 is a side elevation and plan of one form of the bobbin of the swing-type actuator according to the present invention.
Figure 4:
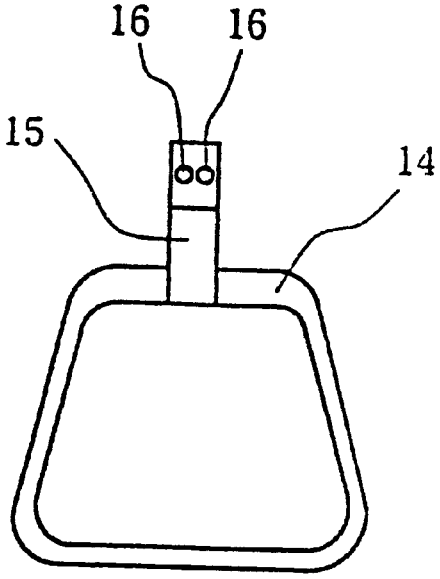
Figure 7:
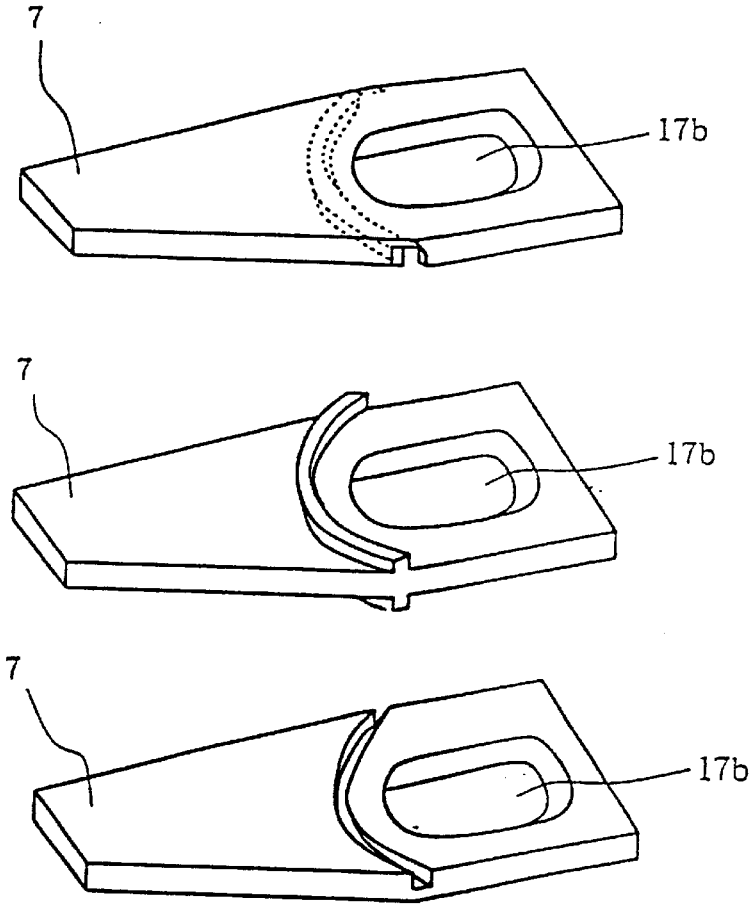
FIG. 7 is a perspective view of one form of the arm for use in the present invention.
Figure 8:
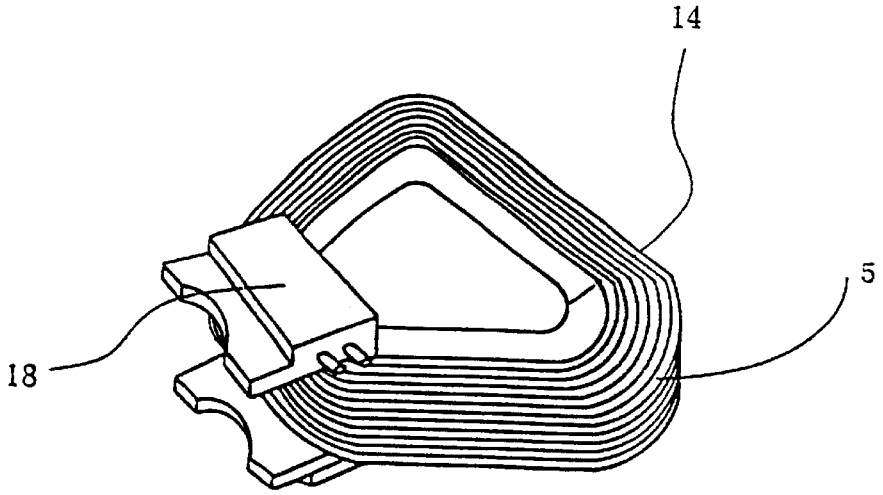
FIG. 8 is a perspective view of one form of the coil bobbin for use in the present invention.
Figure 9:
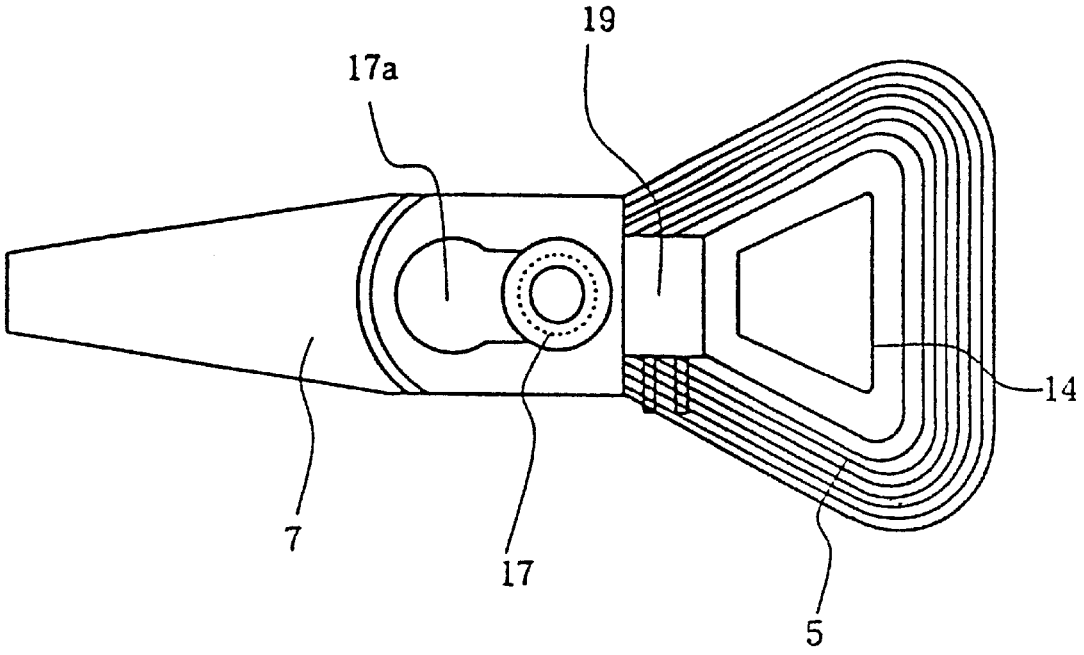
FIG. 9 is a plan and side elevation of the state of the arm and the coil bobbin which are set in the bearing.
Figure 9:
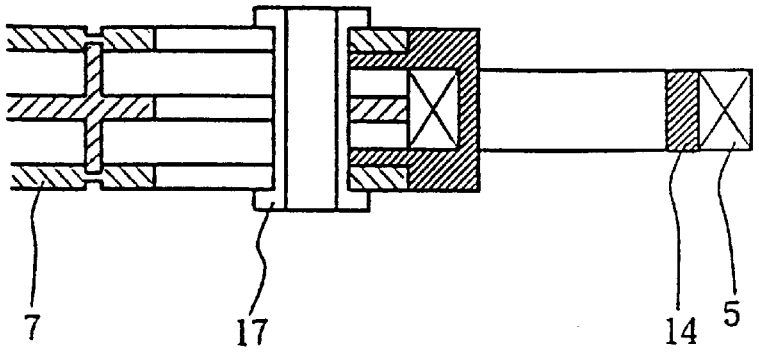
Figure 10:
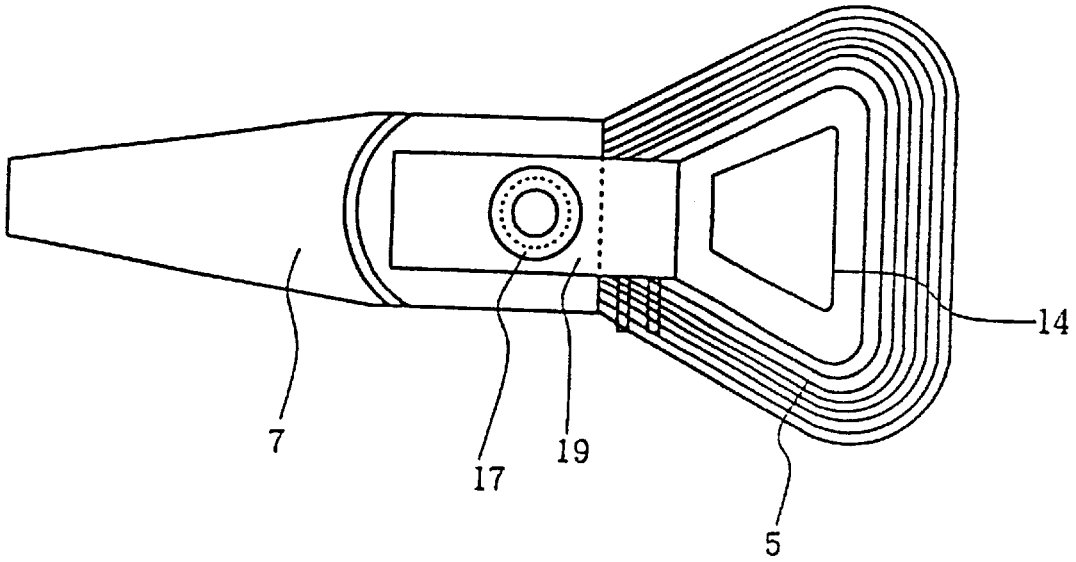
FIG. 10 is a plan and side elevation of the actuator for a magnetic disk unit according to one embodiment of the present invention.
Figure 10:
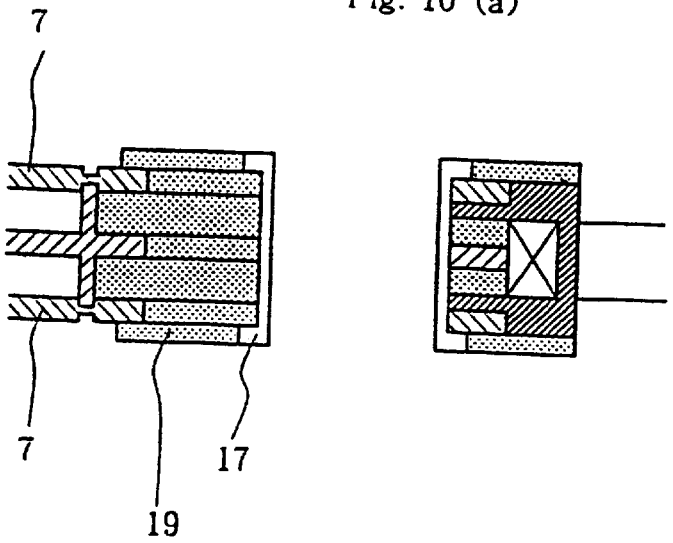
Figure 11:
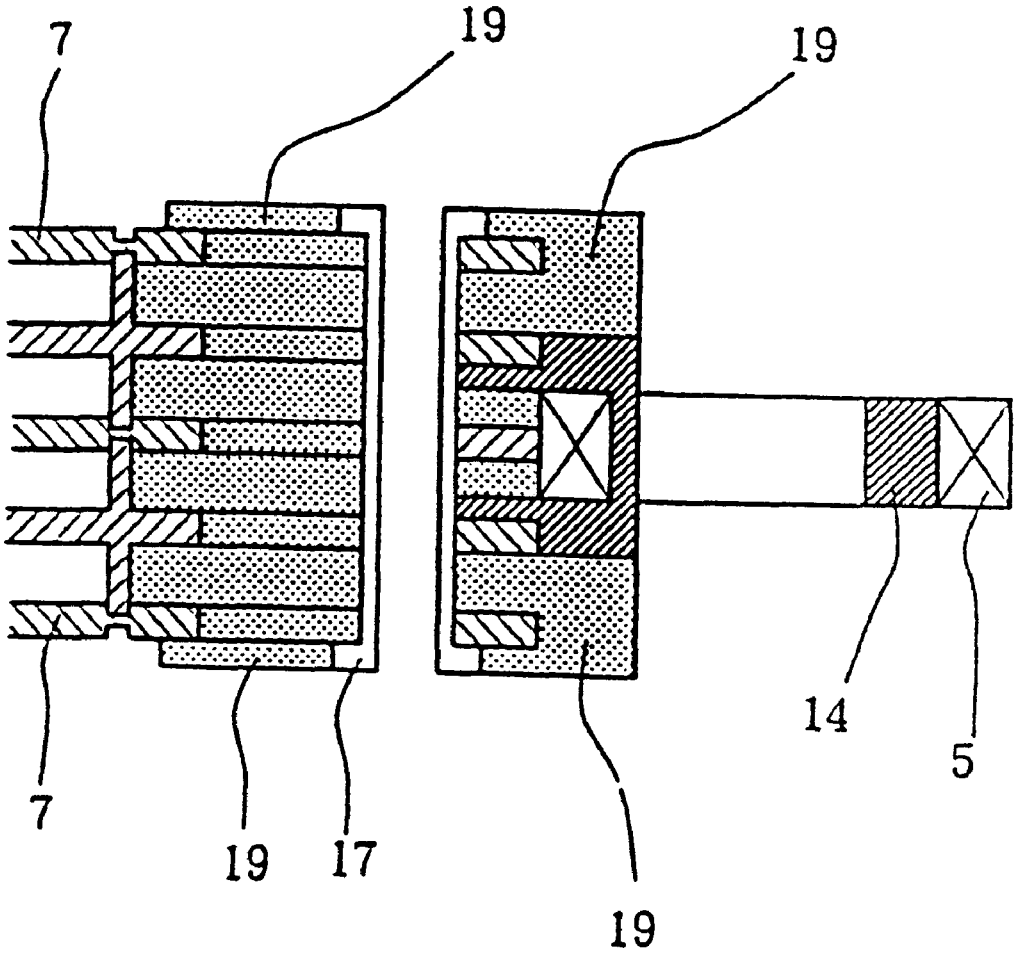
FIG. 11 is a side elevation of the actuator for a magnetic disk unit according to another embodiment of the present invention.

Each of the thermoplastic resins listed in Table 2 was injection molded into a bobbin as shown in FIG. 4. Then, a lead having a diameter of 0.5 mm was wound around the body of the bobbin to form about 10 turns of the lead thereon, thereby obtaining a movable coil. The thickness (T) of the coil was measured at 10 points by the use of a micrometer. The differences of the measurements from the standard value were averaged to thereby obtain a dimensional error. The dimensional error was determined for each of 50 bobbins in the above manner. The maximum, minimum and average of the measured dimensional errors are indicated in Table 2.

TABLE 2

| Ex./ Comp. Ex. | Thermoplastic resin | Dimensional error (μm) max. | min. | av. |
|---|---|---|---|---|
| Ex. 7 | polybutylene terephthalate resin *1 | 0.09 | 0.06 | 0.07 |
| Ex. 8 | polyphenylene sulfide resin *2 | 0.08 | 0.03 | 0.05 |
| Ex. 9 | thermotropic liquid crystal polyester *3 | 0.04 | 0.01 | 0.03 |
| Comp. Ex. 3 | air-core type | 0.17 | 0.05 | 0.12 |

*1: trade name BT-2230, produced by Dainippon Ink & Chemicals, Inc.
*2: trade name R-4, produced by Phillips Petroleum Co.
*3: thermotropic liquid crystal polyester composed of p-hydroxypenzoic acid/terephthalic acid/biphenol/isophthalic acid quaternary copolyester (filled with 30% by weight of glass fiber, melting point of unfilled polymer measured by DSC: 410° C.

p-hydroxypenzoic acid/terephthalic acid/biphenol/isophthalic acid quaternary copolyester (filled with 30% by weight of glass fiber, melting point of unfilled polymer measured by DSC: 410° C., unfilled polymer exhibiting optical anisotropy in the molten state).

EXAMPLES 10 TO 12

Insert molding was performed using the coil bobbin produced in Example 9 and also each of the thermoplastic resins listed in Table 3 as the junction member to thereby obtain an actuator as shown in FIG. 5. Whether or not the coil bobbin was deformed was estimated when the insert molding was performed, and the results are shown in Table 3.

TABLE 3

| Ex. | Thermoplastic resin | Apparent viscosity (measurement temp.) | Deformation |
|---|---|---|---|
| Ex. 10 | polyphenylene sulfide resin *2 | $2.5 \times 10^3$ poise (310° C.) | no |
| Ex. 11 | thermotropic liquid crystal polyester *3 | $5 \times 10^2$ poise (375° C.) | no |
| Ex. 12 | polyether ether ketone resin *4 | $4.5 \times 10^3$ poise (370° C.) | slight |

*4: trade name 4500, produced by ICI Japan Ltd.

INDUSTRIAL APPLICABILITY

As is apparent from the above, not only can the gap between the movable coil and the permanent magnet be narrowed but also the coil bobbin is not deformed by virtue of the use of the bobbin composed of the thermoplastic resin having specific properties in the movable coil of the actuator. Thus, the driving force for swinging the actuator can effectively be obtained. Further, as compared with the use of the conventional wire-wound up coil without the bobbin, the costs of production of the movable coil and assembly of the actuator can markedly be reduced.

Moreover, by virtue of the actuator for a magnetic disk unit according to the present invention, not only can the dimensional accuracy of the movable coil be enhanced but also the inter-product dimensional accuracy dispersion can be minimized with respect to the products comprising the arm and the movable coil joined together, so that a stable driving force can effectively be obtained. Further, improved economy and productivity are ensured.

Also, the following effects are exhibited by the present invention.

(1) The arm is formed of the thermoplastic resin having specific properties, so that miniaturization and weight reduction of the arm can be attained. Accordingly, the magnetic circuit which drives the movable part can be miniaturized. Further, the arm has excellent dimensional stability, rigidity sufficient to support the magnetic head, and excellent properties for damping vibration.

(2) The bearing is composed of a cylinder made of a metal, so that it ensures improved strength and markedly high reliability.

(3) Since a coil bobbin is employed as the movable coil, the movable coil will not be deformed at the time of molding thereof whereby it is not lowered in dimensional accuracy.

(4) The employment of the bobbin permits joining of the arm to the bobbin, so that it is not required to hold a periphery of the coil with an appropriate holding member.

Therefore, the actuator of the present invention can suitably be employed in magnetic, optomagnetic and optical fixed disk units.

What is claimed is:

1. A swing-type actuator for use in a magnetic disk unit which comprises:

a magnetic head as a functional member;

an arm supporting said head;

a movable coil acting in a magnetic circuit, wherein said movable coil is composed of a coil bobbin produced by molding a thermoplastic resin and having grooves provided on its side surface, a coil wire wrapped around said grooves and a pair of terminal pins provided with said coil bobbin for electrical connection to starting and finishing ends of said coil wire; and a fixing member produced by molding a thermoplastic resin for integrally fixing said movable coil and said arm.

* * * * *